United States Patent [19]

Lehmann et al.

[11] Patent Number: 4,966,353

[45] Date of Patent: Oct. 30, 1990

[54] CHIEF FOLDING MACHINE WITH EYE ADHESIVE MOISTENER

[75] Inventors: Werner Lehmann, Gutach; Manfred Fuss, St. Georgen; Joachim Kurtz, Monchweiler, all of Fed. Rep. of Germany

[73] Assignee: Mathias Bäuerle GmbH, St. Georgen, Fed. Rep. of Germany

[21] Appl. No.: 241,082

[22] Filed: Sep. 6, 1988

[30] Foreign Application Priority Data

Sep. 4, 1987 [DE] Fed. Rep. of Germany ..... 3729658

[51] Int. Cl.[5] ..... B42C 1/00

[52] U.S. Cl. ..... 270/45; 493/420; 156/442.1; 156/443

[58] Field of Search ..... 270/21.1, 32, 37, 39, 270/40, 41, 45, 53; 493/243, 249, 260, 264, 266, 420, 917, 930; 156/227, 421, 442.1, 443, 578; 118/253, 255, 257, 247, 244, 220

[56] References Cited

U.S. PATENT DOCUMENTS

| | | | |
|---|---|---|---|
| 2,759,400 | 8/1956 | Randall | 493/266 |
| 3,473,449 | 10/1969 | Thousand | 493/266 |
| 3,511,013 | 5/1970 | Pahlitsch | 270/370 |
| 4,512,845 | 4/1985 | Kobler | 270/37 |
| 4,573,672 | 3/1986 | Lehmann | 270/45 |
| 4,799,989 | 1/1989 | Marzullo | 270/45 |

FOREIGN PATENT DOCUMENTS

| | | | |
|---|---|---|---|
| 464596 | 4/1950 | Canada | 493/266 |

*Primary Examiner*—Edward K. Look
*Assistant Examiner*—Therese M. Newholm
*Attorney, Agent, or Firm*—McGlew and Tuttle

[57] ABSTRACT

A device for folding successively fed sheets which have a plurality of transversely spaced dried adhesive areas thereon includes a plurality of folding rolls arranged in a sheet feedback between which the sheets are fed and which have at least one pocket into which the sheets are fed after they have been folded at least once as they are passed between folding rolls. The sheet wetting device comprises a plurality of moveable belts which are arranged over the sheets as they are fed through the sheet feed path, they are guided and moved through a path in which they overlie each sheet in succession. Construction includes means for holding at least some of the belts into contact with the sheets as they are moved in order to wet the sheets in selected areas in it includes means for passing the belts into association with a belt wetting device or reservoir so that they wet the dry areas which they contact. The construction advantageously includes means for shifting at least some of the belts into contact with the sheets only at selected areas in which the belts are moved into association with the sheets. Arrangement for shifting the sheets or the belts so that they move into contact with each other only in selected areas includes a electro-magnetically operated device to move these elements relatively.

10 Claims, 4 Drawing Sheets

CHIEF FOLDING MACHINE WITH EYE ADHESIVE MOISTENER

BACKGROUND OF THE INVENTION

Field of the Invention

The invention relates particulary to a compressing-folding machine with two folding sites formed by one pair of folding rollers and with two folding pockets assigned to them as well as with an intake device. The intake device is arranged in front of the first folding pocket and it includes a carrier roll or several carrier rollers or disks arranged on a shaft which rests on a folding roll in contact with it and forms with it an intake site. A liquid applicator for the stripwise application of a liquid serving for adhesion purposes on given sections of the material to be folded passing through is arranged in front of the intake site and has at least one rotating applicator element and an associated sheet compression element which, part of the time, and intermittently, can be actuated electromagnetically.

A known compressing-folding machine of this kind ,(DE-OS 25 52 216). is provided with a sheet adhesive applicator arranged in front of the intake site. This consists of an adhesive container and a wheel applying the adhesive in the form of strips onto the passing sheets as well as of a sheet compression device with a bow-like sheet lifter which is operated electromagnetically or hydraulically and which presses the sheets for a time against the circumferential area of the adhesive wheel. The adhesive wheel is continually driven and supplied with adhesive. The length of the adhesive strips created on the sheets is determined by the length of time the sheet lifter applies pressure. For controlling the means actuating the sheet lifter, for example an electromagnet, light barriers are provided which scan the passing sheet. When passing through the folding device the sheets which have adhesive applied to them are folded and the adhesive areas are simultaneously compressed.

In another known adhesive applicator which precedes a multiple-folding device (USP 3,784,185) several adhesive strips are generated simultaneously on a paper web. The paper web is subsequently separated into two halves along the longitudinal center and upon passing the folding device in the region of a folding section is adhesively connected, for example pocket-like and brochure-shaped.

Furthermore, a winding device for the preparation of layers of sheets for book binding is known (DE-PS 278 266). This device includes a fabric web wrapped in several layers on a rotating elliptical package in the reel. Layers with an adhesive strip running transversely are provided on a edge of the package in the reel. For the application of the adhesive a continuous rotating adhesive applicator belt is provided which is supplied with adhesive from a supply container. The wound layers are then cut open on the side of the package in the reel opposing the adhesive application edge. With a pinion-type cutter of the package in the reel, the winding edges to which adhesive has been applied, are subsequently slid into a folding device having two compression rollers.

In recent times material to be folded such as printed forms in the form of paper sheets are encountered which at their edges are provided with adhesive strips and/or adhesive spots, whose adhesive in the dry state does not exert an adhesion effect on other dry areas, but only in a wetted state and under pressure will it become connected by adhesion.

With the known adhesive applicators reactivation of the dry adhesive sites is just as readily possible as achieving a permanent adhesion connection of such reactivated adhesive sites when passing through the folding device because, for reactivation of the dry adhesive sites with wetting liquid other application means are required and also because the compression time when passing through the folding device is too short.

SUMMARY OF THE INVENTION

The invention is, therefore, based on the task of creating a compressing-folding machine which is capable of reactivating by wetting, the dry adhesive sites of the passing material to be folded passing through at high speed, and to fold the material to be folded in the manner of miscellaneous folding and subsequently to permanently adhere together to form closed shipping material.

According to the invention the liquid applicator for wetting several dry adhesive sites of the material to be folded to which adhesive agents have been pre-applied is provided with several belt-shaped liquid carriers arranged in the passing tracks of the adhesive sites which first pass through a liquid container with wetting fluid. The applicator has sheet compression elements which can be actuated singly or in groups. The compression elements generate a permanent adhesion on the adhesive sites in the folded state of the material and it is arranged in a folding depository after the last folding site, and has one or several pressure-loaded compression belts which rest on the conveyor belt.

With a compressing-folding machine equipped in this manner the material to be folded is provided with dry adhesive strips and/or adhesive spots which can be wetted in one pass at relatively high speed on the locations-provided with adhesive. The material is subsequently folded and formed into a miscellaneously folded product closed by adhesion at the margins, which otherwise would be open, without the need of special manual intervention or manual activity. By wetting the dry adhesive sites the adhesive is reactivated, in a known manner, and made to adhere so that upon passing through the last folding site, and a compression device arranged downstream, permanent adhesion is effected.

Furthermore, an advantage exists that adhesive parts which adhere to the liquid carriers dissolve in the liquid container so that self-cleaning of the liquid carrier takes place continuously. At the end of a pass, the possibility exists of allowing the liquid carrier to run without load through the liquid supply so as to clean them, possibly with the addition of a stripper. The belt-shaped liquid carriers permit, in addition, arranging the liquid container at a spatially favorable site of the machine removed from the application site.

With, as well as also without, the liquid container the possibility exists of guiding the liquid carriers past a sponge or felt-like liquid supply where the liquid carriers absorb during their contact the amount of liquid required for wetting the adhesive strips and/or adhesive spots. Here, within the liquid container a pressing cushion consisting of sponge, of sponge-like material or of felt can be arranged which continuously exerts a cleaning effect onto the passing liquid carrier.

In an embodiment of the invention ensurance is given that in advantageous manner, the sheet compression elements, without interfering with the passage of the material to be folded, press the material to be folded with a relatively high pressure, in any event strong enough for sufficient reactive wetting, in the region of the adhesive sites to be wetted against the liquid carrier. Moreover, the provided compression means permit a very space-saving construction and precisely controllable manner of function.

According to another embodiment of the invention with simple means the transport of the wetting liquid from the liquid container or supply to the wetting site can be realized in uniformly apportioned quantities. Also a certain friction or wiping effect is advantageously generated—even at high speed and low compression pressure so that sufficient wetting and activation of the adhesive is endured. In addition, with the speed of the liquid carriers the quantity of supplied wetting liquid can also be regulated.

By implementing the invention according to an embodiment of the invention in a simple and reliable manner adhesive spots which do not extend over the entire length of the folding material, but, for example are applied at the trailing end section of the material to be folded, can also be selectively wetted and activated and, specifically, in that the liquid carriers assigned to these adhesive spots are only briefly brought into contact with the material to be folded when these adhesive spots are located precisely underneath the liquid carriers. Undesirable wetting of other areas of the material to be folded can thereby be prevented. Due to the varying nature of the sheet compression elements belt pulleys maybe provided to influence the folding goods thickness by the pressing strength or the wetting quality can largely be eliminated.

In order to prevent that parts of the wetted adhesive are deposited on the folding rolls and adhere there, drains are provided. Also, carrier belts and compression belts are supported so as to allow, with simple means, the compression pressure necessary to achieve a reliable, firm, and permanent adhesive adhesion to become effective on a transporting path of minimum length.

The compressor belts and compression belts are arranged in order to achieve in the process, for example a pressing time of four to five seconds, at the customary speeds of the compressing-folding machines the supporting plate and the conveyor belts as well as the compression belts would have to have a length of approximately 2 m or more which would not be acceptable for operating in an office.

Thus, it is possible to achieve even with relatively short, approximately 25 cm long, compression belts and approximately 40 cm stretched conveyer belts a pressing time of five seconds, in that the material to be folded leaving the last pressing site is aligned scale-like on the conveyer belt and carried multi-layered underneath the compression belts. The scale-like layering of the material to be folded on the carrying belt requires solely a relatively slight increase of the compression pressure and hence, of weight application which rests on the compression belt respectively the compression belts.

The compression rollers function in known manner for the scale-like layering of the material to be folded.

Accordingly it is an object of the invention to provide a device for wetting a plurality of transversely spaced areas of a sheet in the course of folding the sheet so that it might eventually be formed into a closed envelope having adhesively secured areas along at least one marginal edge and also between intermediate portions of end panels thereof.

A further object of the invention is to provide a device which is associated with a sheet folding mechanism and which includes means for detectably wetting various areas of dry adhesive on the sheet which is being folded.

A further object of the invention is to provide a device for folding and wetting a dry adhesive on sheets which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 1:
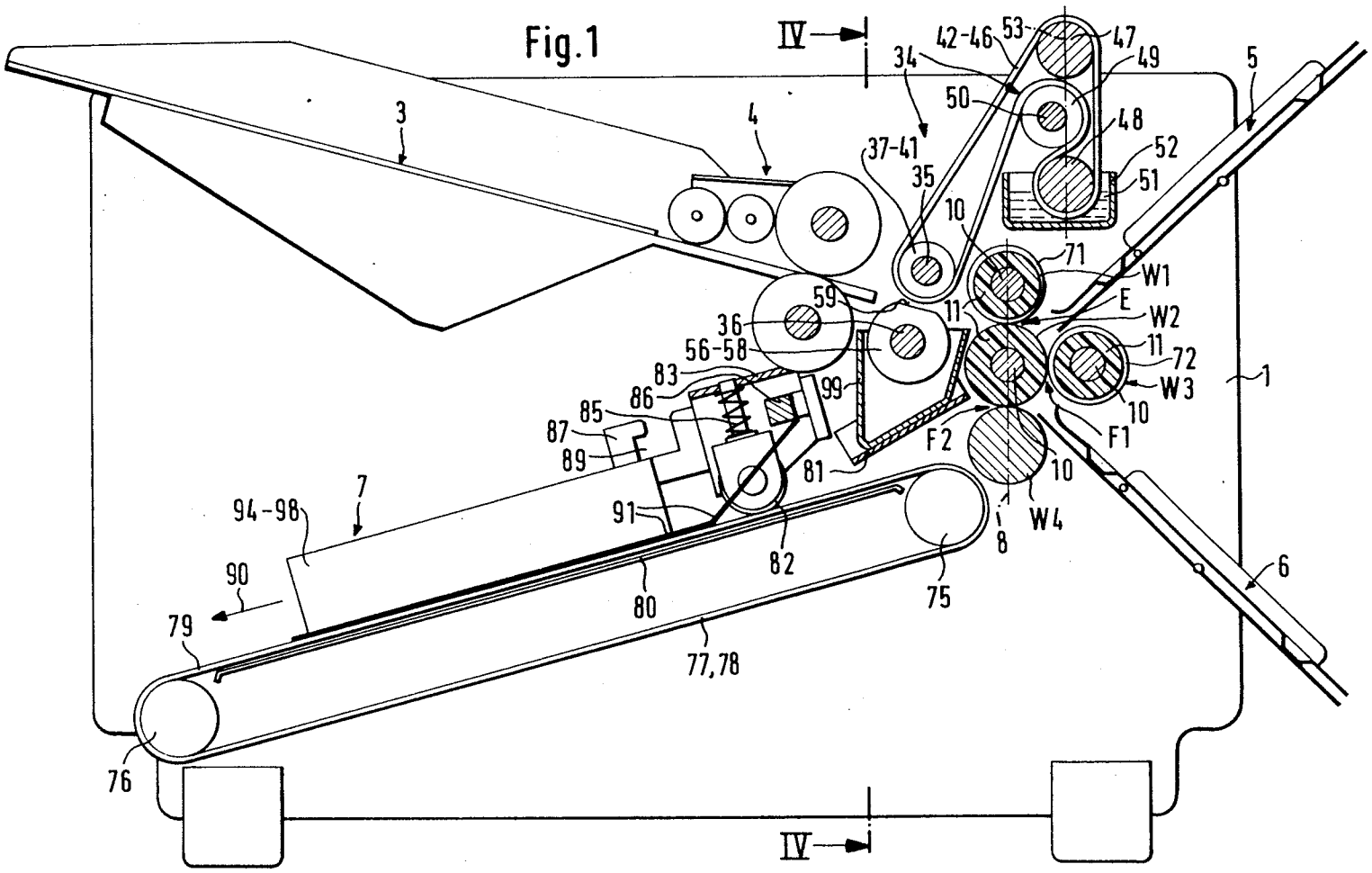
FIG. 1 is a schematic sectional view of a compressing-folding machine with wetting device and compression arrangement constructed in accordance with the invention.

Referring to the drawings in particular the invention embodied therein comprises a device generally designated 1 for folding successively fed sheets 17 which have a plurality of transversely spaced dry adhesive areas 19, 20 and 23. In accordance with the invention the folding device includes means for wetting selective areas of the sheet as it is fed through a sheet feeding path and includes a liquid applicator generally designated 34.

The folding machine operates to feed the sheet between folding rollers W1, W2, W3 and W4. The folding rollers W1, W2, W3 and W4 are arranged in conjunction with pockets 5 and 6 which in the embodiment shown makes two folds of the sheet 17 along lines 24 and 25.

As can be seen in the drawing, the shown compressing-folding machine has between two frame side plates 1 and 2 a feed table 3 with a sheet separating arrangement 4, a carrying roller W1, folding rollers W2, W3, and W4, two folding pockets 5 and 6 and a folded goods depository 7. The arrangement of the carrying roller W1 and the folding rollers W2 and W4 is such that their horizontal axis lie above one another in a vertical plane 8 while the folding roller W3 is so arranged that its axis likewise extending horizontally lies in the same horizontal plane 9 as the axis of the center folding roller W2.

While the carrying roller W1 and the folding rollers W2 and W3 comprise cylindrical steel core 10 and an elastic synthetic cover (lining) 11, for example of polyurethane, the folding roller W4 is formed as pure steel roller with smooth surface. The folding roller W2 and the carrying roller W1 arranged above and in contact with it, form together an intake site E, through which the material to be folded arriving from the feeding table 3 is grabbed and carried in the first folding pocket 5 against a stop not further shown here. The folding rollers (sic) W2 and W3 form the first folding site F1, from which the material folded there for the first time is carried into the second folding pocket 6, where it also runs against a stop not further shown here, in order to lastly receive the second folding at the second folding site F2 formed between the folding roller W2 and the folding roller W4 and to arrive on the folded material depository 7 which, below, is described in still greater detail.

Figure 3:
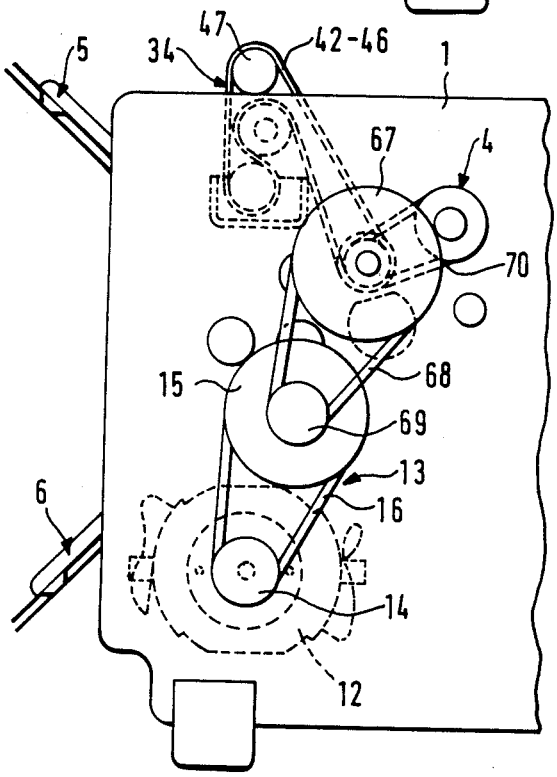
FIG. 3 is an opposing side view of FIG. 2.

The carrying roller W1 and the folding roller W2, W3 and W4 are pivoted in frame side plates 1 and 2 . Through (not shown) gears they engage each other and are driven by an electro-motor 12 shown in dashed lines in FIG. 3 via belt drive 13 including two belt pulleys 14 and 15 as well as of a belt 16.

Figure 6:
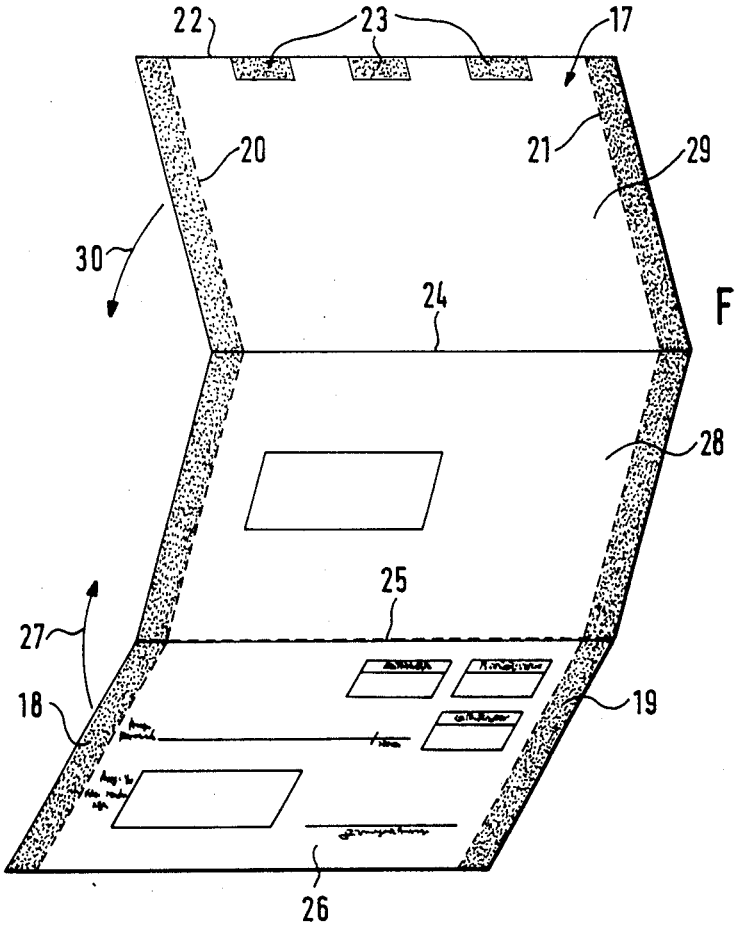
FIG. 6 is a perspective view of a sheet to be folded with indicated folding edges and adhesive sites; and, FIG. 7 is a perspective view of a folded and closed sheet.

In FIG. 6 a sheet 17 of the material to be folded to be processed in the shown compressing-folding machine is shown schematically. This sheet is provided along its longitudinal edge with two dry adhesive strips 18 and 19 which extend over its entire length and which can be separated through slit perforation 20 respectively 21. In addition, at the upper end edge 22 three adhesive spots 23 are arranged distributed over the width. The material to be folded, a sheet 17, is to be folded at folding edges 24 and 25 indicated in FIG. 6 in the form of miscellaneous folding in such a way, that initially the lower sheet section 26 is folded in the direction of arrow 27 along folding edge 25 and placed on the center sheet section 28, while, subsequently, in the second folding site F2 the upper sheet section 29 is folded along folding edge 24 and placed in the direction of arrow 30 on the backside of the lower sheet section 26.

In order to activate the dry adhesive of adhesive strips 18 and 19 as well as of adhesive spots 23, it is necessary, to wet it sufficiently and to compress it while wet after or during folding so that as final product folded material or shipping material ready to be shipped originates which is closed by adhesion at the otherwise open side edges 31 and 32 as well as also at the lower transverse edge 33. Opening this folded material can take place by tearing off the perforated adhesive strips 18 and 19 as Well as through undoing the connected adhesive spots 23.

Figure 4:
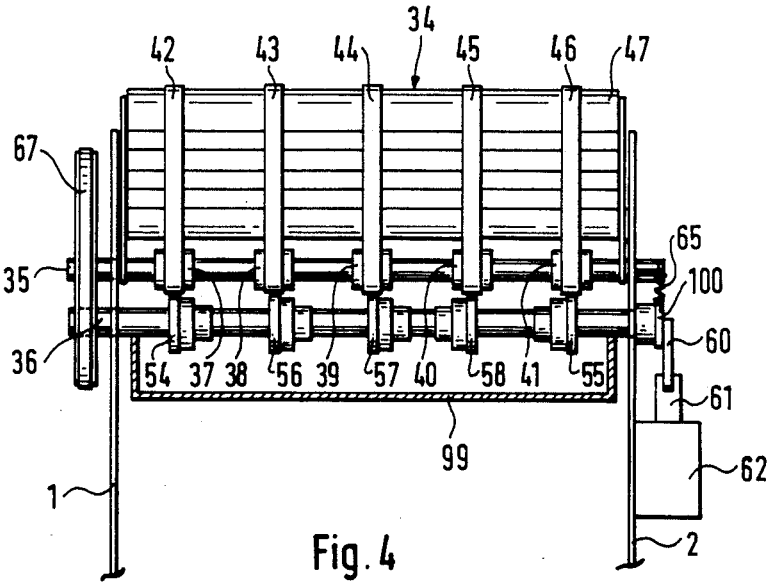
FIG. 4 is a section taken along IV—IV of FIG. 1.

For wetting the adhesive strips 18 and 19 as well as the adhesive spots 23 the compressing-folding machine is provided with a liquid applicator 34 which in the following is explained in detail. Between the intake site E formed by the carrying roller W1 and the folding roller W2 and the sheet separating device 4, two shafts 35 and 36 are arranged extending in the horizontal position parallel to each other as well as parallel to the carrying respectively folding roller W1 and W2, which are both pivoted in the frame side plates 1 and 2. On shaft 35 a total of five belt pulleys 37, 38, 39, 40 and 41 are fastened (FIG. 4), whose axial distance from each other is identical and correspond to the distances which the adhesive strips 18 and 19 and adhesive spots 23 have from each other. Over these belt pulleys 37 to 41 run liquid carriers in the form of flat belts 42, 43, 44, 45, and 46 which run simultaneously over two deflection shafts 47 and 48 as well as over guide pulleys 49 of a common shaft 50.

Also the axis of the deflection shafts 47 and 48 as well as shaft 50 run parallel to each other and parallel to the axis of the folding rollers W2 to W4. The deflection roller 48 is so arranged that it projects with part of its circumference below a liquid level 51 of a tub-shaped liquid container 52. It is evident form FIGS. 1 to 3, that the two deflection rollers 47 and 48 are arranged in a vertical plane 53 above one another at a given distance form each other and that the shaft 50 with the deflection pulleys 49 lies in between so that the flat belt runs without interference form the deflection roller 48 to the belt pulleys 37 to 41. The flat belts 42 to 46 comprises a material of, at most, weak elasticity and are provided on their outside with a textile fabric which has a given absorbency for taking up wetting liquids form the liquid container 52. Instead of the textile fabric a foamed material or a felt cover could also be provided.

Figure 2:
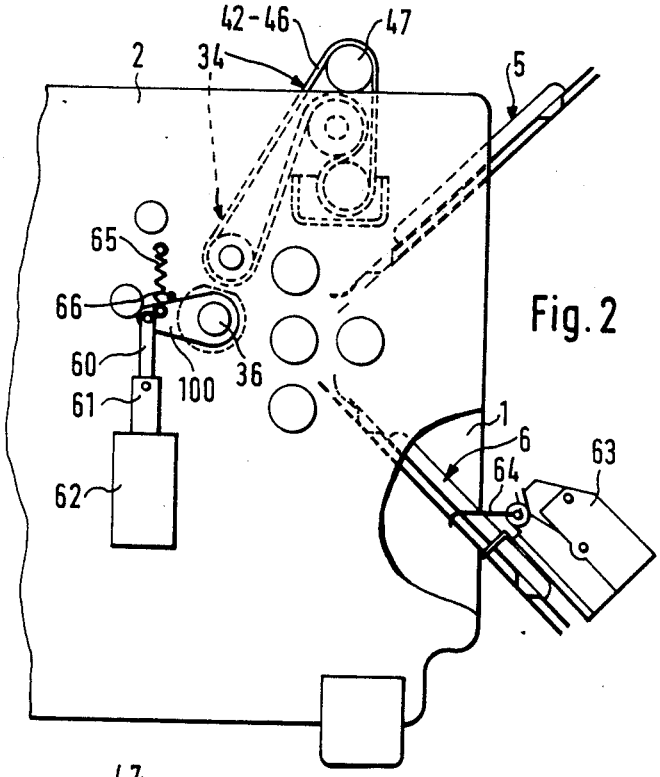
FIG. 2 is a partial side view of the compressing-folding machine shown in FIG. 1.

It is evident from FIG. 1 that the arrangement of the shaft 35 with its belt pulleys 37 to 41 is such that the flat belts 42 to 46 running over it form a tangent to the plane in which the sheets of material to be folded run from the feeding table 3 to the intake site E and that these flat belts 42 to 46 can be brought into contact with the adhesive strips 18 and 19 and the adhesive spots 23 if a sheet 17 passes through underneath them. The shaft 36 which is arranged below shaft 35 and is parallel to it, is provided with two fully cylindrical freely rotatably supported compression disks 54 and 55, which continually press the adhesive strips 18 and 19 of the passing sheets 17 against the flat belts 42 and 46 of the two outer belt pulleys 37 and 41.

To the flat belts 43, 44 and 45, which are provided for wetting the adhesive spots 23, opposing sheet compression elements in the form of cam-like compression disks 56, 57, and 58 are so assigned that the flattenings 59 and connected non-rotably with shaft 36. The compression disks 56, 57 and 58 are so arranged that the flattenings 59 normally, i.e. in their inactive angular position, are directly opposite the belt pulleys 56 to 58 and these compression disks 56 to 58 disks in this angular position do not press the passing sheets 17 on the flat belts 43, 44, and 45.

However, in order to effect at that moment at which also the adhesive spots 23 pass the contact site with the flat belts 43, 44, and 45 compression of these adhesive sites to the flat belts 43, 44, and 45 functioning as liquid carriers, the shaft 36 is connected via a lever arm 59 and a cover plate 60 to a solenoid plunger 61 of an electromagnet 62. This electromagnet 62 when electrically excited brings about a rotation of shaft 36 and the cam-like compression disks 56, 57 and 58 against the direction in which the material to be folded passes through in such a way that the cylindrical surface area sections of the cam-like compression disks 56, 57 and 58 simultaneously press the adhesive spots 23 of sheet 17 on the flat belts 43, 44, and 45. Electromagnet 62 is driven by an electrical switch 63, whose contact arm 64 projects into the inlet path of the folding pocket 6. The arrangement of switch 63 respectively the contact arm 64 in the folding pocket 6 is such that the electrical excitation of the electromagnet 62 takes place shortly before the adhesive spots 23 have arrived at flat belts 43, 44, and 45 respectively at their belt pulleys 38, 39, and 40. Since the excitation of the electromagnet 62 may in each case only be very brief, for driving the electromagnet 62, apart from the electrical switch 63 with its contact arm 64, an electronic time switch element is provided, which is capable of generating very short switching pulses, which does, indeed, respond to the actuation of switch 63. However, this keeps the operating time of the electromagnet 62 considerably shorter than means switch 63 is closed. In order to return shaft 36 into its starting position after the electromagnet 62 is switched off, a tension spring 65 is provided, which pulls the lever arm 59 against a stop pin 66, which determines the resting position of the shaft 36 and the lever arm 100.

Instead of compression disks 56, 57, 58 which are non-rotatably arranged on shaft 36 and which, therefore, exert a braking effect on the passing material to be folded, fully cylindrical compression disks can be rotably arranged on the eccentric bearing sections of shaft 36. These compression disks may consist of a hard, however elastic material or have a cover of such material so that different thicknesses of the material to be folded do not lead to functional failures. On the other hand, such thickness compensation is also possible through elastic belt pulleys 41 to 47 or also through elastic covers (lining) of the flat belts 42 to 46.

The flat belts 42 to 46 are driven via shaft 35, which for this purpose is provided with a belt pulley 67, which is mechanically connected by belt 68 and a belt pulley 69 with the belt pulley 15 driving the carrying roller W1 and the folding rollers W2 to W4 Via the belt pulley 15 and an additional belt drive 70 simultaneously the sheet separation device 4 is also driven. In order to achieve at high operating speeds and/or . with lesser compression pressure effective, i.e., reactivating wetting of the adhesive strips 18 and 19 respectively the adhesive spots 23 on the passing sheets 17, the speed of the flat belts 42 to 46 is so selected through the choice of corresponding step-down gearing that it differs from the speed at which the sheet run through, i.e. from the circumferential speed of folding rollers W2 to W4. Thereby between the adhesive strips 18 and 19 respectively the adhesive spots 23, on the one hand, and the flat belts 42 to 46 functioning as liquid carriers at the contact side a sliding friction with wiping effect occur, through which wetting and activation of the dry adhesive is strongly intensified. The speed cf belts 42 to 46 is preferentially chosen to be smaller, i.e. approximately half as great. As the speed of the material to be folded. Through correspondingly, possible settable selection of the speed of the liquid carriers quantitative apportioning of the wetting liquid at the application site is possible.

In order to avoid that parts of the moistened respectively activated adhesive can be deposited at the carrying roller W1 and the folding roller W3, the surface areas of the carrying roller W1 and the folding roller W3 provided at those places at which the two adhesive strips 18 and 19 and the three adhesive spots 23 run through, with groove-like recesses 71 and 72 through which the adhesive strips 18 and 19 and adhesive spots 23 pass without contact.

If the adhesive of adhesive strips 18 and 19 as well as adhesive spot 23 had the properties of contact adhesives, then the compression pressure exerted during passage of the second folding site F2 onto the folded sheet 17 would be sufficient to ensure permanent adhesion of the adhesive strips 18, 19, and adhesive spots 23 on the particular opposing surface. Since the adhesive is soluble in water respectively in any liquid solvent or wetting liquid of which the adhesive strips 18 and adhesive spots 23 consist as a rule, entering into a permanent adhesive connection requires a minimum compression time of a few seconds, it is required to either reduce the speed at which the material to be folded passes through the compressing-folding machine, or, in order to achieve greater output to provide special additional means for generating this longer compression pressure.

Figure 5:
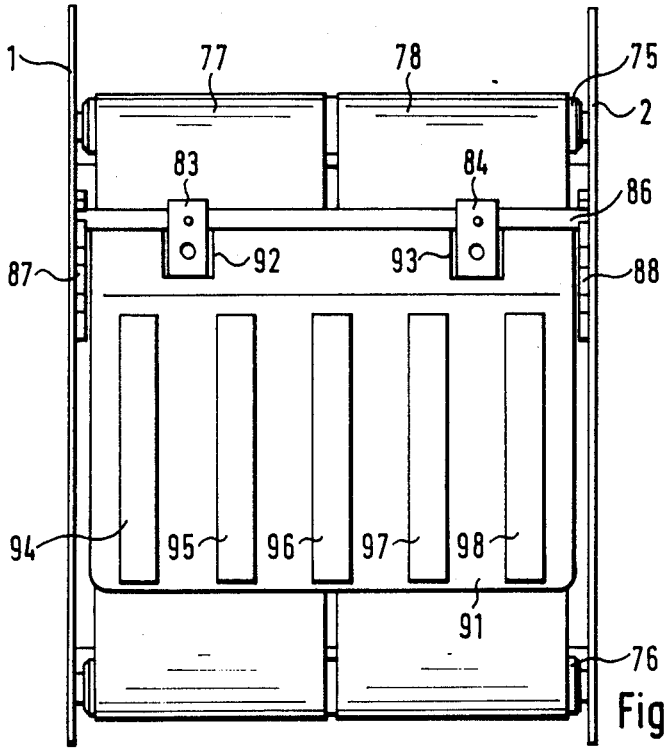
FIG. 5 is a top plan viewing the outlet end compression device.
Figure 7:
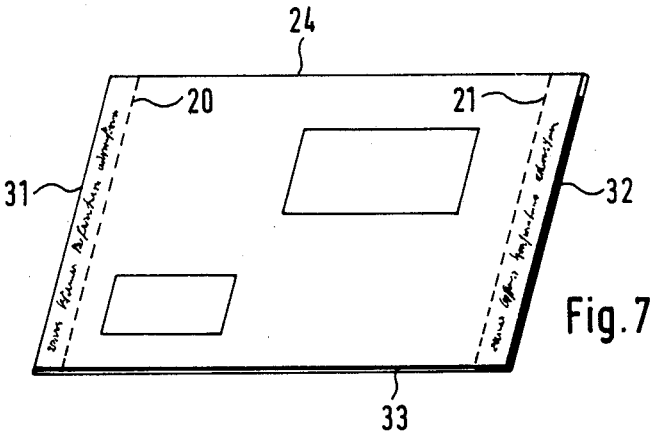

In the embodiment according to the invention such additional means for generating a compression pressure lasting for several seconds is provided in the area of the folded goods depository 7. These are explained in greater detail below in conjunction with FIGS. 1 and 5. The folded goods depository 7 has two continuous conveyer belts 77 and 78 stretched over one drive roll 75 and one deflection roll 76, whose upper sides 79 run over a common stationary support plate 80 which, due to the fact that the two rolls 75 and 76 are staggered in height and have an obliquity in the machine direction. In this connection, the higher drive shaft roll 75 is in the immediate vicinity of the metal folding roller W4 and, hence, is arranged directly behind the last folding site F2. Above it and at a slight distance is an oblique guide sheet 81 which guides the folded goods leaving folding site F2 downward on to the upper reach 79 of conveyor belts 77 and 78. In the machine direction behind the guide sheet 81 are at a slight distance from it two compression rolls 82 of which only one is clearly shown in FIG. 1. The compression rolls 82 are held in support yokes 83 and 84 rests on one of the conveyer belts 77 and 78 under the influence of pressure springs 85. The support yokes 83 and 84 are fastened on one crossbar 86 which is square in cross section, which extends between the two frame side plates 1 and 2 parallel to the carrying and folding rollers W1 to W4 and is mounted displaceably, however torsion-tight, in holders 87 and 88 on the inside of the frame side plates 1 and 2. These holders 87 and 88 comprise of plate-shaped flat parts with rectangular cutouts 89, which are open on the top and in which the crossbar 86 can be inserted protected against torsion. This permits placing the compression rolls 82 at different distances from the last folding site F2 on conveyer belts 77 and 78, which is required in order to adapt the arrangement of this compression roll 82 to the particular final format of the folded goods. Conveyer belts 77 and 78 are driven by the drive shaft 75 in the direction of arrow 90 at a speed which is significantly lower than the circumferential speed of the carrying roller W1 and the folding rollers W2 to W4 so that the folded goods arriving form the last folding site F2 at the compression roll 82 are reduced to a far slower transporting speed. The speed of conveyer belts 77 and 78 can, for example, be a fifth to one sixth of the circumferential speed of folding rollers W2 to W4. Thereby the folded goods arriving sequentially at the drive rolls 82 are layered scale-like above one another and moved by conveyer belts 77 and 78 out of the machine at a lower speed. At crossbar 86 is fastened a compression belt 91 extending over the entire width of the two conveyer belts 77 and 78 which comprises a thin flexible low-friction smooth steel belt and which has at the places where the two support yokes 83 and 84 with the compression rolls 82 are arranged respective recesses 92 and 93. On this compression belt 91 as compression means long weights 94, 95 96, 97, and 98 are so arranged that they lie precisely above the passing-through tracks of the two adhesive strips 18 and 19 as well as adhesive spots 23 and press them while they are passing through strongly against the opposing surface of sheet 17. The length of the section of the compression belt resting on the material to be folded passing through and corresponding also the length of the weights 94 to 98 is so chosen that this covers at least half the length of upper belt 79 of the two conveyer belts 77 and 78, and the transporting speed of the conveyer belts 77 and 78 is such that the run-through time of the material to be folded under compression belt 91 and, hence the length of time during which compression takes place is approximately four to six seconds. This ensures that the adhesive strips 18 and 19 respectively adhesive spots 23 which were wetted with the aid of the liquid applicator 34 have become reliably and permanently adhesively connected and the miscellaneous folding is closed on all sides as shown in FIG. 7.

In order to prevent that drops possibly originating from the flat belts 42 to 46 in the region of the belt pulleys 37 to 41 from falling onto conveyer belts 77 and 78, a drip pan 99 is placed below shaft 36 which is fastened on guide sheet 81.

While specific embodiments of the invention have been shown and described in detail to illustrate the application of the principles of the invention, it will be understood that the invention may be embodied otherwise without departing from such principles.

What is claimed:

1. In a device for feeding successive sheets which have a plurality of transversely spaced dry adhesive areas thereon which device includes a plurality of folding rolls arranged along a sheet feed path and between which the sheets are fed and which includes at least one pocket to which the sheets are fed after they have been folded at least once by the folding rolls, the improvement comprising; a sheet wetting means comprising a plurality of moveable belts arranged over said sheets, guide means for guiding said belts so they move through a path overlying said sheets, drive means for driving said belts, compressor support means arranged on the side of said sheet opposite the said belts and urging at least one of said belts into contact with the sheet as it is fed between said compressor means and said belt, and wetting means positioned to wet said belts as they are moved so that the wet belts moisten those dry adhesive areas of said sheets with which they are pressed into contact by said compressor support means said compressor support means including a means for shifting at least one of said belts into contact with said sheet to cover a dry adhesive spot area and a compressive disk for maintaining at least one of other of said belts into substantially continuous contact with at least one other of said dry adhesive areas of said sheet, said means for shifting at least one of said belts into contact with said sheet comprising an electromagnetic intermittently actuable member connected to said compressor support means and carrying at least one compressor element which is moveable thereby into association with said sheet to urge it into contact with said belt.

2. In a device according to claim 1, wherein said wetting means includes a liquid applicator said belts comprising endless belts and means for guiding said belts into said liquid applicator said sheet wetting device being located before said folding rolls.

3. A folding machine according to claim 1, wherein said belts are driven at a speed which is different from the speed of advance of said sheet.

4. A compressing-folding machine according to claim 1, including a support plate, said belts being guided over said support plate, said support plate being positioned to urge said belts into engagement with dry adhesive areas of said sheet.

5. A compressing-folding machine according to claim 1, wherein said belts comprise a single belt member having a transversely extending cross bar with projecting belt portioned fastened over said cross bar.

6. A compressing-folding machine according to claim 1, wherein said belts are constructed and adjusted in respect to the sheet to be folded so that there is at least three to four seconds in which the compressor pressure of the belts act on said sheets.

7. A compressing folding machine according to claim 1, wherein said belts are driven at a speed which is one sixth-one third of the circumferential speed of said folding rollers.

8. A compressing-folding sheet according to claim 1, wherein a portion of the belts rest on said heavy loaded compression rolls of said compressor support means.

9. The device according claim 1 wherein said folding rolles include a surface with annular groove-like recesses.

10. A compressing folding machine comprising a first and second set of opposed folding rollers, means for advancing a series of sheets in succession through a path extending between said first and second rollers, a third roller engageable with at least one of said first and second rollers, a folding pocket positioned to receive the sheet fed between said first and second rollers and to hold it for subsequent feeding between said first and third rollers, a second pocket arranged at the exit between said first and second rollers, the arrangement of said folding rollers being such that the sheet which is fed there through is folded into two spaced parallel folding lines, said sheets having marginal areas along each edge with dry adhesive and spaced dry adhesive spots between said edges at selected locations, means for moistening the sheets as they are fed between said first and second folding rollers including compressive support means arranged on one side of said sheet, said moistening means including a moistening belt and a plurality of belt support pulleys arranged at spaced locations over said sheet on which said moistening belt is guided over said pulleys which overlie said compressive support means, liquid supply means through which said belt is dipped as it is moved, said moistening belt and said compressive support means being arranged that sheets are compressed therebetween, said moistening belts being located such that selected areas of the said moistening belts are deflected against said dry adhesive areas of said sheets to cause wetting of said areas, said compressive support means comprises a rotatable shaft having a plurality of axially spaced compressive disks over number and location sot hat they are opposed to respective ones of said belts at least one of said disks being an extended cam may be moved toward and away from said sheet and an associated belt said eccentric disk being rotatably so that they may be spaced away from said sheet so as to prevent the belt from contacting any area on said sheet, including an electromagnet having an armature carrying at least one of said compressive disks being moveable by said electromagnet into the direction toward an engagement of said sheet for selectively holding said sheet against said belt at selected areas as the sheet is fed.

* * * * *